US007943214B1

(12) United States Patent
Bamberg et al.

(10) Patent No.: US 7,943,214 B1
(45) Date of Patent: May 17, 2011

(54) INK-JET TRANSFER SYSTEMS FOR DARK TEXTILE SUBSTRATES

(75) Inventors: Ulf Bamberg, Jestetten (DE); Peter Kummer, Neunkirch (CH); Ilona Stiburek, Zurich (CH)

(73) Assignee: Arkwright Advanced Coating, Inc., Chesapeake, VA (US)

( * ) Notice: Subject to any disclaimer, the term of this patent is extended or adjusted under 35 U.S.C. 154(b) by 0 days.

(21) Appl. No.: 09/980,466

(22) PCT Filed: Jun. 1, 1999 (Under 37 CFR 1.47)

(86) PCT No.: PCT/IB99/00976

§ 371 (c)(1), (2), (4) Date: Apr. 12, 2006

(87) PCT Pub. No.: WO00/73570

PCT Pub. Date: Dec. 7, 2000

(51) Int. Cl.
*B41M 5/40* (2006.01)

(52) U.S. Cl. ..... 428/32.17; 428/32.18; 428/32.23; 428/32.3; 428/32.34; 428/32.38

(58) Field of Classification Search ..... 428/32.17, 428/32.18, 32.23, 32.3, 32.34, 32.38
See application file for complete search history.

(56) References Cited

U.S. PATENT DOCUMENTS

| | | | | |
|---|---|---|---|---|
| 5,747,148 | A * | 5/1998 | Warner et al. | 428/212 |
| 6,177,187 | B1 * | 1/2001 | Niemoller et al. | 428/32.12 |
| 6,884,311 | B1 * | 4/2005 | Dalvey et al. | 156/235 |
| 7,749,581 | B2 * | 7/2010 | Dalvey et al. | 428/32.5 |
| 7,754,042 | B2 * | 7/2010 | Dalvey et al. | 156/235 |
| 7,766,475 | B2 * | 8/2010 | Dalvey et al. | 347/105 |
| 7,771,554 | B2 * | 8/2010 | Dalvey et al. | 156/235 |
| RE41,623 | E * | 9/2010 | Schwendimann et al. | 156/235 |
| 7,824,748 | B2 * | 11/2010 | Dalvey et al. | 428/32.69 |
| 2010/0323132 | A1 * | 12/2010 | Dalvey et al. | 428/29 |

FOREIGN PATENT DOCUMENTS

DE 196 28 341 A1 * 1/1998

* cited by examiner

*Primary Examiner* — Betelhem Shewareged
(74) *Attorney, Agent, or Firm* — Barlow, Josephs & Holmes, Ltd.

(57) ABSTRACT

An ink-jet transfer system is disclosed, as well as a transfer printed product which is highly wash-resistant, color-fast and environment-friendly, and a process for producing the same and its use in a printing process by means of the disclosed ink-jet transfer system. The disclosed ink-jet transfer system has a substrate, a hot-melt layer applied on the substrate and at least one ink-absorbing layer which comprises a mixture of a highly porous pigment and a binder. The molecules of the pigment and if required of the binder and hot-melt layer can form chemical bonds with the dyeing molecules of the ink.

21 Claims, No Drawings

INK-JET TRANSFER SYSTEMS FOR DARK TEXTILE SUBSTRATES

TECHNICAL FIELD

The present invention relates to an ink-jet transfer system or an ink-jet transfer print, respectively, according to the preamble of claim 1, as well as a method according to the independent claims 14 and 16.

BACKGROUND ART

Transfer prints enjoy a big popularity, as they allow the application of any graphic presentation, patterns, images or type faces, in particular on clothes like T-shirts, sweatshirts, shirts or also other textile substrates like for instance mousepads. Of particular interest are ink-jet transfer systems (ink-jet transfer prints), providing the potential users with the possibility of an individual selection of electronically processible and by means of a computer memorizeable graphic presentations, and which can eventually be printed or iron pressed, respectively, onto his desired garment or another textile substrate (support), respectively, by the user himself. Thereby, in a first step, the desired, electronically processible image is produced by the user of the transfer print by means of a computer, which is transmitted from the computer to a suitable printer, for example an ink-jet printer, which on its turn prints the desired image onto the transfer system. The transfer print thus prepared has to display a structure which allows the further use for the print onto for example a textile substrate. By means of a suitable transfer print, the desired graphic presentation is brought to adhesion onto the desired textile substrate. Usually, graphic presentations are applied under supply of heat and pressure by a hot copy, and optionally by a prior cold copy onto the desired textile substrate.

In the recent years, efforts have been undertaken in order to improve the hot transfer systems as well as to enable the printing of the desired graphic presentation onto the textile substrate with a satisfactory quality.

For instance, U.S. Pat. No. 5,242,739 describes a heat-sensitive transfer paper which is capable to fix a image which comprises the following components: a) a flexible cellulose containing, unwoven, textile-like paper which comprises a superior and an inferior surface and b) a melting transfer-film layer which is capable to receive an image, which is situated onto the superior surface of the paper support, c) as well as optionally an intermediary hot-melt layer. The film layer consists of about 15 to 80 weight-% of a film-forming binder and about 85 to about 20 weight-% of a powder like thermoplastic polymer, whereby the film forming binder and the thermoplastic polymer have a melting point of between about 65° C. and 180° C.

U.S. Pat. No. 5,501,902 represents a further development of U.S. Pat. No. 5,242,739, which consists of a two-layer system as well, whereby, however, for the improvement of the printing image, an ink viscosity agent is further contained. Furthermore, in the transfer print of U.S. Pat. No. 5,501,902, preferably a cationic, thermoplastic polymer is contained for the improvement of the ink-absorbing capacity.

As pigments for the receipt of the ink dye-stuff, in the prior art, usually polyesters, polyethylene wax, ethylene-vinylacetate-copolymers, and as a binder, polyacrylates, styrene-vinylacetate-copolymers, nitrile rubber, polyvinylchloride, polyvinylacetate, ethylene acrylate copolymers and melamine resins are mentioned.

In WO 98/30749 (Océ-Switzerland) an ink-jet transfer system is described, which comprises a carrier material, a hot-melt layer being applied onto the carrier material and at least an ink-receiving layer. Thereby, the ink-receiving layer is a mixture of a highly porous pigment and a binder, whereby the molecules of the pigment and optionally of the binder as well as optionally of the hot-melt are capable to form chemical bonds with the dyestuff molecules of the ink.

A special difficulty, however, is associated with transfer prints, which shall be applied onto a dark textile support. Since the dyestuffs are transparent against dark backgrounds, i.e. maximally perceptible as shadow, first of all a light contrast background has to be created to make the desired colored image better visible. According to the prior art, for this, in the course of a 2 step method or a one step method, a transfer print is applied onto a dark piece of textile. In case of the conventional 2 step method, a white textile fabric equipped with a hot-melt adhesive on the back is laminated with a transfer foil that was imprinted by a xerographic method (or ink-jet) and then pressed with the hot-melt adhesive side on the dark garment to be imprinted (T-shirt) by means of a transfer press at 180° C. and a pressure of about 7 bar. The image side with the thin foil (transfer layer) on it, thereby is protected by a silicon paper. After the transfer operation that lasts about 10 seconds, the silicon paper is removed. The adhesion of the transfer print system on the dark garment is achieved by means of a polyethylene or polyester/polyamide textile adhesion (i.e. a hot-melt adhesive) of the contrast support on the textile substrate.

The whole system is felt to be unpractical by the user in so far as one needs a laminator and/or a textile transfer press for the realization of the method, whereby in particular the wash-proofness or the adhesion of the white contrast support on the dark piece of textile, respectively, still is particularly unsatisfactory and in addition sustainably impairs with each washing.

The known systems that are usable by means of a one step method are based on a white, thick transfer foil with a thickness of about 400 to 600 μm which can be imprinted by an ink-jet method or a xerographic method and subsequently transferred on a dark piece of textile by means of a transferred press. The disadvantages of this system are in particular the unsatisfactory image quality immediately after the transfer on the piece of textile. The images look faint and blurred. Furthermore, the whole system is comparatively thick, makes an unaesthetic impression (corslet like) and it is not breathable. An additional major disadvantage is the fact that the user who does not dispose of a transfer press and consequently switches to the use of a commercially available iron is confronted with a sustainably impaired adhesion of the transfer foil on the piece of textile. This loss of adhesion is further accelerated by repeated washings.

A further disadvantage of both conventional print systems is their application process on the textile substrate, whereby the application of a contrast background on the piece of textile under markedly high pressure can not be performed by private persons without an adequate equipment. The pressures of at least about 7 bar ($=7\times10^5$ Pa) often required for this can only be generated by a cost intensive transfer press, whereby the users are mainly interested in a simple iron pressing by means of a commercially available iron. The above mentioned disadvantages did significantly lead to the consequence that the currently sold transfer print systems did not spread out on the market as desired, or even were successful, respectively. On the contrary there still exists a great need for satisfactory systems that do not have the above mentioned disadvantages.

DISCLOSURE OF THE INVENTION

Hence, it was one objective of the present invention to provide a textile transfer print system which at least partly avoids the above mentioned disadvantages. In particular, a transfer print system for a dark textile support should be provided which on the one hand yields the desired high contrast, a high resolution, and on the other hand avoids the unsatisfactory washproofness due to insufficient adhesion of the transfer print on the textile support, and finally which can be applied on a piece of textile as uncomplicated and efficiently as possible i.e. in the course of a one step method by means of an iron.

Furthermore, it was also an objective of the present invention to provide a method for the production of textile transfer print systems for dark textile substrates with high washproofness.

Finally, it was an objective of the present invention to provide a printing process, whereby by means of textile transfer print systems for dark textile substrates, graphic presentations with high quality or high washproofness, respectively, can be applied on textile substrates in a single step.

The above mentioned objectives are resolved according to the independent claims. Preferred embodiments are mentioned in the dependent claims.

The ink-jet transfer system according to the present invention comprises or consists of, respectively, a carrier material (base layer), an adhesive layer applied on the carrier material—preferably a hot-melt layer—which comprises dispersed spherical (globular) polyester particles of a granular size of less than 30 μm, a white background layer being applied on the adhesive layer and at least one ink-receiving layer being applied on the background layer. The white background layer which is directly on the adhesive layer, according to the present invention, comprises or consists of at iron pressing temperatures non-fusible (i.e. up to about 220° C.) permanently elastic plastics, filled with white—also (up to about 220° C.) non-fusible pigments. The elastic plastics must not melt at iron pressing temperatures in order not to provide with the adhesive layer, e.g. the hot-melt, which provides the adhesion to the textile substrate, an undesired mixture with impaired (adhesive and cover) properties. Furthermore, the white background layer has to be elastic in order not to lead to a brittle fracture by subsequent mechanic stresses. Elasticity, in the sense of the present invention, means an expansion of at least 200%, preferably of between 500-1000% and in particular preferably of about 800%.

Preferred elastic plastics for the white background layer are selected from the group comprising the polyurethanes, polyacrylates or polyalkylenes or also natural rubber (latex), respectively. The most preferred elastic plastics contain or consist of polyurethanes.

Suitable pigments are only those which do not melt at iron pressing temperatures. The filled white layer or the polymers contained therein, respectively, such e.g. polyurethane must not melt, because otherwise the white pigments sink or penetrate, respectively, into the textile substrate. With this, a reduction or even a destruction, respectively, of the white background colour would be associated which according to the invention shall be provided to provide a background for dark prints. Particularly preferred white pigments are inorganic pigments selected from the group comprising $BaSO_4$, ZnS, $TiO_2$, ZnO, SbO. Also organic pigments are usable for the white background layer as far as they are non-fusible at iron pressing temperatures. These pigments can be blended alone or also in a mixture with other (up to 220° C.) non-fusible carrier agents, as for example silicates or aluminates.

Thus, the present invention succeeds in providing a transfer system which comprises a white background layer in the print system itself, i.e. between the adhesive layer and the ink-receiving layer, whereby the entire system, in spite of the non-fusible white background layer, surprisingly fulfills the following requirements:

a) The alltogether 4 chemically different layers are in the course of the coating process, as well as the melting process (the iron pressing onto the textile substrate), in particular chemically, compatible. There occurs no repellent or detachment, respectively, of the white background layer from the adhesive layer and/or the ink-receiving layer from the white background layer.

b) The 4 chemically different layers furthermore show a good adhesion to each other after production of the transfer system so that there is no splintering off or detachment, respectively, of single layers of the transfer system that is iron pressed on the textile substrate.

c) The transfer system shows also an excellent adhesion and elasticity on the textile substrate, particularly after the iron pressing on the textile substrate. Said elasticity is of great importance since the iron pressed transfer system should not become brittle and should not effect a sustainable impairment of the graphic presentation on the textile substrate. Particularly in case of sports stresses (e.g. pulling at or crumpling of the T-shirt, respectively) the image imprinted on the textile support has to adhere tightly.

d) Finally, the inventive transfer system is washable as a composite on the textile substrate without that the color fatness as well as the adhesion on the textile substrate suffers.

The glued lamellar structure is in a way a sandwich structure in which the white background layer is glued to the textile substrate, whereby no mixing of the background layer with the adhesive layer, e.g. a hot-melt layer by a melting process is possible and the entire system is nevertheless that flexible that the graphic presentation printed on the ink-receiving layer can not be detached by mechanical stresses.

The adhesive layer has to be essentially or completely fusible and must only be adhesive in a fused condition. In a very particularly preferred embodiment, the adhesive layer which is directly on the carrier material is a pure hot-melt layer. The hot-melt layer is essentially a wax-like polymer which is easily fusible and thus can for example be transferred onto the textile substrate together with the imprinted ink-receiving layer by iron pressing. Due to its wax-like properties, the hot-melt layer primarily effects the adhesion to the textile substrate. On the other hand, the hot-melt layer also has to mediate a good adhesion to the white background layer which is chemically totally different (not wax-like, non-fusible). This is inventively achieved in that in the hot-melt layer, very small spherical polyester particles of a granular size of less than 30 μm are dispersed. These spherical polyester particles in turn are chemically more related to the white background layer (than the pure hot-melt wax components) so that during melting they can form or enhance, respectively, the adhesion to the white background layer. A particle size of less than 30 μm is required for that the particles do not bulge from the layer and such cause troubles during coating. The spherical polyester particles are preferably obtained in that for example kryo ground polyester is added with stirring together with the wax-like hot-melt compounds during the production of a dispersion and is melted to 30 μm small drops (emulsion). After the cooling, the drops solidify, small beads develop and thus a dispersion. A preferred hot-melt compound is for example an ethylene acrylic acid copolymer or a PU dispersion. Together with the spherical polyester particles of a granular size of less than 30 μm, said compound is processed to a hot-melt layer dispersion.

As adhesive layer, besides a pure hot-melt, also a hot-melt adhesive dissolved in a solvent can be used. For example a solvent comprising adhesive on the basis of polyamides or polyethylenes which on the one hand effects a good adhesion to the textile substrate and on the other hand to the background layer are suitable for the realization of the present invention.

In a preferred embodiment, the adhesive layer, however, contains or consists of a pure hot-melt since said hot-melt forms the desired adhesion to the white background layer and to the textile substrate by means of a comparatively simple external controlling means, i.e. by means of iron pressing, in a convenient but efficient manner.

The ink-receiving layer (ink layer) is situated on the white background layer and primarily comprises a highly porous pigment and a binder. The highly porous pigment provides on the one hand a pure mechanical receipt of the ink during printing of the desired graphic presentation whereby a maximal porosity ensures an especially high absorbability. Binders are necessary to bind the highly porous pigments on the product surface to allow the processing (imprinting) of the ink-jet transfer system.

In principle, all known, mainly highly porous pigments, are suitable as ink-receiving layer for the purposes of the present invention: Examples are polyesters, PE-wax, PE-powders, ethylene-VAC-copolymers, nylon, epoxy compounds. As binders are suitable polyacrylates, styrol-butadiene-copolymers, ethylene-VAC-copolymers, nylon, nitrile rubber, PVC, PVAC, ethylene-acrylate-copolymers.

Preferably the at least one ink-receiving layer comprises a mixture of a highly porous pigment and a binder whereby more preferably the molecules of the highly porous pigment and optionally of the binder and optionally of the adhesive layer, e.g. the hot-melt layer, are capable to form, essentially covalent, bonds to the dyestuff molecules of the ink. This has the advantage that the respective dyestuffs, after the printing on the textile substrate, for instance by iron pressing, are not anymore primarily mechanically bonded, but as a result of—essentially covalent—bonds are chemically bonded to the molecules of the pigment and the binder and optionally the hot-melt. This is achieved in that the molecules of the pigment and optionally of the binder and optionally of the hot-melt dispose of reactive groups that are capable to form covalent bonds to the also reactive groups of the dyestuff molecules of the ink.

The essentially covalent bonds between the dyestuff molecules of the ink and the molecules of the pigment as well as of the binder are, among others, formed upon providing energy, for instance by iron pressing (at about 190° C.) the inventive ink-jet transfer system on the textile substrate.

For the printing of the ink-jet transfer system, for instance by means of an ink-jet printer, in the market, usually acid dyestuffs are used in printer inks, for example azo-dyestuffs according to formula I.

(I)

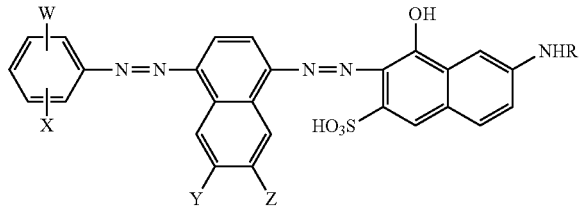

W = COOH
X = H or COOH
Y & Z = H, COOH or $SO_3H$
R = H, $CH_2COOH$ or $CH_2CH_2COOH$

The molecules of the ink dyestuffs are primarily available as anions in solution and also dispose of reactive groups which allow the formation of chemical bonds to the reactive groups of the pigment molecules as well as optionally the binder molecules. The reactive groups are usually one or more sulfonate groups or carboxylate groups per dyestuff molecule. Under suitable conditions, for instance through heating during the iron pressing of the ink-jet transfer system onto the textile substrate, covalent or also rather ionic bonds or intermediary valence bonds, respectively, between said sulfonate groups or carboxylate groups, respectively, and the reactive groups, for example amino groups, of the pigment or binder, respectively, can be formed. But in particular, the covalent bonds of the dyestuff molecules to the molecules of the ink-receiving layer, with formation of e.g. sulfonamides (—$SO_2$NH—R) or amide groups (—CONH—R), respectively, (besides of rather amphotheric $SO_3^-NH_3^+$—R groups) are particularly preferred.

As an example, the poly[1,2-bis(aminomethyl-cyclohexyl) ethane-adipic acid amide] of the formula (II) is mentioned which generates covalent bonds (sulfonamide groups or acid amide groups, respectively) with its terminal amino groups upon reacting with the acid groups of an azo-dyestuff.

(II)

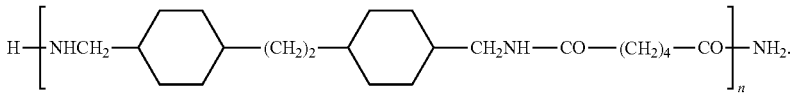

MODES FOR CARRYING OUT THE INVENTION

In a preferred embodiment, the ink-receiving layer of the inventive ink-jet transfer system consists of a highly porous pigment and a binder, whereby at least one of both components, in particular the pigment being present in bigger amounts disposes of reactive amino groups that are capable of forming essentially covalent bonds to the dyestuff molecules of the liquid ink.

In a particularly preferred embodiment of the present invention, the ink-receiving layer comprises a highly porous polyamide pigment and a binder consisting of a soluble polyamide, whereby the terminal, free amino groups of the polyamide pigment and of the polyamide binder are capable of fixing reactive groups, for example sulfonate groups or carboxylate groups of the dyestuff molecules. Because of that, with the pigment component as well as the binder component, a chemical fixation of the dyestuff molecules can be achieved.

Besides the inventive requirement of the capability of the formation of essentially covalent bonds between the dyestuff molecules of the ink and the molecules of the pigment as well as the binder, the ink-jet transfer system according to the present invention has to display a big absorbability or receptivity, respectively, of ink in order to guarantee a clear print image. This requirement is achieved by providing a pigment, preferably a polyamide pigment with a high porosity.

Preferred polyamide pigments which are used for the ink-jet transfer systems according to the present invention preferably display a spherical, for instance a globular geometry and an interior surface which is as high as possible. The granular sizes of the used polyamide pigments are in a range of about 2 μm and about 45 μm, whereby a range of 2 to 10 μm is particularly preferred. The bigger the granular size of the polyamide pigments, the more the surface of said pigments is closed and thus the ink-receiving capacity is reduced or even rendered impossible, respectively. The interior surface of the highly porous pigment amounts to at least about 15 $m^2/g$, preferably it is between about 20-30 $m^2/g$.

It turned out that in particular a polyamide pigment with the trade name "Orgasol" displays the required properties, in particular the highgrade porosity.

A highly porous polyamide pigment with an interior surface of at least about 15 $m^2/g$ and a granular size of about 2 μm and about 45 μm is obtained by means of an anionic polyaddition and a subsequent controlled precipitation process. In contrast to the conventional production methods in which a polyamide condensation product, for example as a granulate, is prepared which is then milled, the polyamide pigments are actually grown and the growth of the pigments is ceased upon reaching the desired granular size. 85-95% of the polyamide pigments such obtained show the desired form and granular size, whereby only maximally 15% have a smaller or bigger granular size.

For an ink-receiving layer with highly porous polyamides being used as pigments, the binder preferably consists of a polyamide as well. The polyamide used as a binder is different concerning its properties from the polyamide pigment in so far, as it is employed as a solution and thus does not has to comply with specific form requirements. The use of polyamide as a binder is therefore less critical. It has only to be soluble in a suitable solvent, for instance alcohol or a alcohol-water mixture, respectively, and preferably disposes of free terminal amino groups by means of which dyestuff molecules, for example sulfonate groups of azo-dyestuffs or ester groups can be fixed.

The ratio of the highly porous pigment and the binder in the ink-receiving layer of the inventive ink-jet transfer system amounts to between about 5:1 and 1:1, preferably 3:1 and 2:1 and very much preferred 2.4:1.

The hot-melt layer which is preferably used in the ink-jet transfer system according to the present invention as adhesive layer is directly on the removable carrier material and serves to transfer the graphic presentation imprinted by the ink-jet printer on the textile substrate and to ensure an adhesion to the white background layer. Said transfer is, for instance, effected by a cold copy, i.e. by iron pressing, cooling down and removing the carrier layer (baking paper). During the iron pressing, the hot-melt layer and the ink-receiving layer, but not the white background layer are molten. This way, the image imprinted on the ink-receiving layer is transferred on the textile substrate without any fusing associated distortions.

The hot-melt layer preferably used as adhesive layer in contrast to the highly porous pigment, binder as well as the background layer, is essentially wax-like, i.e. it can be fused. Usually, hot-melts melt in a range of about 100-120° C. while the highly porous pigments preferably melt in a range of 120-180° C., preferably 140-160° C. A usual hot-melt is for instance an ethylene acrylic acid copolymer dispersion.

Further additives can be contained in the ink-jet transfer system according to the present invention, however, upon the use of such additives, it has to be paid attention that their use does not deteriorate the washproofness of the eventually obtained transfer print. Because of procedural reasons, for instance, it is reasonable to use a dispersing additive for organic pigments in the preparation of the inventive ink-jet transfer system.

As a support (cover layer) for the cold copy, nearly any separating paper can be used, preferably a heat-resisting paper, for example a silicon paper is used.

Besides the ink-jet transfer system itself, an additional aspect of the present invention is a method for its preparation. The coating method comprises the following steps:

a) application of an adhesive layer, preferably a hot-melt layer, which comprises dispersed spherical polyester particles of a granular size of less than 30 μm onto a carrier material, for instance silicon paper, by means of a coating means for instance a coating machine, whereby a layer thickness of about 30 to 40 μm is adjusted, thereafter drying the hot-melt layer and b) application of a white background layer consisting of, at iron pressing temperatures non-fusible (i.e. up to about 220° C.), elastic plastics which are filled with white, preferably inorganic, pigments onto the hot-melt layer, preferably with a resulting layer thickness of about 20-35 μm, c) application of at least one ink-receiving layer dispersion onto the white background layer and d) drying the ink-jet transfer system.

The double/multiple application of the ink-receiving layer according to step c) provides the advantage that a smooth and even surface as well as an ink-receiving layer with a balanced thickness is formed, whereby the printing process or the resulting print image, respectively, is influenced in a positive way.

First, the graphic presentation to be applied onto the textile substrate is laterally correctly printed onto the ink-jet transfer system such obtained by a usual printer, e.g. an ink-jet printer (ink-jet-plotter), cut out, removed from the support (e.g. silicon paper), covered with baking paper and afterwards iron pressed onto the desired textile substrate, for instance a T-shirt, at a temperature of between about 160 and 220° C., preferably of 170° C., during at least 10 seconds. The lowest layer is the carrier material which is removed and discarded before the application of the graphic presentation. As the preferred cover paper, a heat-resistant silicon paper (baking paper) is used. The printed graphic presentation obtained in such a way (cold copy) is smooth and faint.

In the following, the present invention shall be illustrated by two examples whereby the examples are not to be construed as limiting the scope of protection.

Example 1

Preparation of an Ink-Jet Transfer System

In a first step, the hot-melt layer is applied onto a carrier material: Thereby, a silicon paper of a layer thickness of about 0.1 mm is coated with an ethylene acrylic acid copolymer comprising dispersed spherical polyester particles of a granular size of between 5-25 μm. The ratio of ethylene acrylic acid copolymer and spherical polyester particles is about 60:40 and the resulting layer thickness of the hot-melt layer is about 30 μm.

Subsequently, a white background layer (polyurethane foil) with a thickness of about 40 μm containing about 15 weight-% $TiO_2$ is applied onto the silicon paper coated with the hot-melt.

On said elastic background layer of polyurethane/$TiO_2$ a dispersion containing the ink-receiving layer is applied in two steps. In the first step, a layer thickness of 15 μm is applied and in the second step, a layer thickness of 15 μm is applied, whereby a total layer thickness of the ink-receiving layer of 30 μm results.

The ink-receiving layer was previously prepared as follows: an ethanol/water mixture in the ratio of 3:1 is placed in a vessel and a soluble polyamide binder is dissolved therein under heating to 45° C. Afterwards the highly porous polyamide pigment "Orgasol 3501 EX D NAT1" with a granular size of 10 μm as well as an interior surface of about 25 $m^2/g$ pigment is dispersed in the solution.

In order to stabilize the dispersion, a dispersing additive for organic pigments commercialized by the Company Coatex with the product designation COADIS 123K is introduced and the dispersion is stirred during about 10 minutes at room temperature.

On the coating machine, the solvent is allowed to evaporate in order to obtain a solid ink-receiving layer on which the desired graphic presentation can be printed by means of an ink-jet printer.

The desired foils can be cut arbitrarily according to the required needs.

Example 2

Use of an Ink-Jet Transfer System for Printing

The ink-jet transfer system prepared in example 1 is used in order to print a graphic presentation on a T-shirt. Thereby, in a first step, the desired electronically processible and stored graphic presentation is printed by a computer by means of an ink-jet plotter in a laterally correct way onto the sheet which has been obtained as the ink-jet transfer system in example 1.

Afterwards, the print is removed and put with the white side onto the desired side of the selected T-shirt and iron pressed by means of a hot iron (baking paper+temperature of about 190° C.) during 10 seconds. Afterwards, the T-shirt such processed is cooled down to about room temperature and the baking paper, i.e. the silicon paper is removed. The image such obtained is shining and matt.

While in the present invention, preferred embodiments of the invention are described, it has clearly to be pointed out that the invention is not limited thereto and may be otherwise practiced in the scope of the following claims.

What is claimed is:

1. An ink jet transfer system, comprising:

a) a carrier material;

b) an adhesive layer applied onto said carrier material, said adhesive layer including dispersed spherical polyester particles of a granular size of less than 30 μm;

c) a white background layer applied onto the adhesive layer; said white background layer including an elastic plastic and white inorganic pigment, wherein said elastic plastic and white inorganic pigment do not melt at a temperature up to about 220° C.; and d) an ink-receiving layer applied onto said white background.

2. The ink-jet transfer system of claim 1, wherein the ink-receiving layer comprises a binder, whereby molecules of the binder are capable of forming chemical bonds to ink dyestuff molecules.

3. The ink-jet transfer system of claim 1, wherein the ink-receiving layer comprises a pigment, whereby molecules of the pigment are capable of forming chemical bonds to ink dyestuff molecules.

4. The ink-jet transfer system of claim 2, wherein the dyestuff molecules are azo-dyestuff molecules.

5. The ink-jet transfer system of claim 3, wherein the dyestuff molecules are azo-dyestuff molecules.

6. The ink-jet transfer system of claim 1, wherein the ink-receiving layer comprises a polyimide binder.

7. The ink-jet transfer system of claim 3, wherein the ink-receiving layer comprises a polyimide pigment.

8. The ink-jet transfer system of claim 7, wherein the ink-receiving layer comprises a polyamide pigment having a surface area of at least about 15 $m^2/g$ and a mean granular size of about 2 to 25 μm and a polyimide binder.

9. The ink-jet transfer system of claim 8, wherein the ratio between the pigment and the binder is between about 5:1 and about 1:1.

10. The ink-jet transfer system of claim 9, wherein the ratio between the pigment and the binder is about 2.4:1.

11. The ink jet transfer system of claim 1, wherein the elastic plastics of the white background layer are selected from the group consisting of polyurethanes, polyacrylates and polyalkylenes.

12. The ink-jet transfer system of claim 1, wherein the white inorganic pigments in the white background layer are selected from the group consisting of BaSO4, ZnS, TiO2, ZnO, and SbO.

13. The ink jet transfer system of claim 1, wherein the adhesive layer is a hot-melt layer.

14. The ink-jet transfer system of claim 13, wherein the hot-melt layer comprises a mixture of an ethylene acrylic acid copolymer and polyester particles of a granular size of less than or equal to 20 μm.

15. The ink-jet transfer system of claim 1, wherein the carrier layer comprises a heat-resistant separating paper.

16. The ink-jet transfer system of claim 15, wherein the heat-resistant separating paper is silicon paper.

17. The ink jet transfer system of claim 1, wherein the ink-receiving layer further'comprises a dispersing additive for the pigment.

18. An ink-jet transfer system, characterized in that it comprises:

a) a carrier material;

b) an adhesive layer being applied onto said carrier material;

c) a white background layer being applied on the adhesive layer consisting of elastic plastics which are non-fusible at temperatures up to 220° C. and which are filled with white inorganic pigments; and d) at least one ink-receiving layer.

19. The ink-jet transfer system according to claim 18 wherein the adhesive layer is a hot melt adhesive layer.

20. The ink jet transfer system according to claim 19, wherein a) said carrier material comprises a silicon paper;

b) an adhesive in said hot melt adhesive layer is selected from the group of ethylene acrylic acid copolymer, polyurethane dispersion, polyamide, polyethylene and mixtures thereof;

c) said elastic plastics of said white background layer are selected from the group consisting of polyurethanes, polyacrylates, polyalkylenes and latex and said white inorganic pigments are selected from the group comprising $BaSO_4$, ZnS, $TiO_2$, ZnO, SbO and mixtures thereof; and d) said at least one ink-receiving layer comprises a binder and a porous polyamide pigment.

21. The ink-jet transfer system according to claim 20, wherein b) said adhesive in said adhesive hot melt layer is an ethylene acrylic acid copolymer; and c) said elastic plastic of said white background layer is selected from the group comprising polyurethanes and said white inorganic pigment is $TiO_2$.

* * * * *